US005277369A

United States Patent [19]

Moriya et al.

[11] Patent Number: 5,277,369

[45] Date of Patent: Jan. 11, 1994

[54] MICROMILLING DEVICE

[75] Inventors: Hiroyuki Moriya; Kiyoshi Hashimoto; Kazunari Muraoka, all of Kanagawa, Japan

[73] Assignee: Fuji Xerox Co., Ltd., Tokyo, Japan

[21] Appl. No.: 826,661

[22] Filed: Jan. 29, 1992

Related U.S. Application Data

[63] Continuation of Ser. No. 592,026, Oct. 2, 1990, abandoned.

[51] Int. Cl.[5] ..... B02C 19/06

[52] U.S. Cl. ..... 241/40; 241/5

[58] Field of Search ..... 241/40, 39, 5

[56] References Cited

U.S. PATENT DOCUMENTS

| | | | |
|---|---|---|---|
| 1,099,579 | 6/1914 | Stobie | 241/40 |
| 1,597,656 | 8/1926 | Morton | 241/40 X |
| 1,847,009 | 2/1932 | Kollbohm | 241/40 |
| 1,935,344 | 11/1933 | Andrews et al. | 241/40 X |
| 2,155,697 | 4/1939 | Young | 241/40 X |
| 3,482,786 | 12/1969 | Hogg | 241/40 X |
| 3,675,858 | 7/1972 | Stephanoff | 241/5 |
| 4,089,472 | 5/1978 | Siegel et al. | 241/40 X |
| 4,504,017 | 3/1985 | Andrews | 241/40 |
| 5,133,504 | 7/1992 | Smith et al. | 241/5 |

FOREIGN PATENT DOCUMENTS

| | | | |
|---|---|---|---|
| 51-100374 | 2/1975 | Japan . | |
| 51-100375 | 2/1975 | Japan . | |
| 5664754 | 10/1979 | Japan . | |
| 57-84756 | 5/1982 | Japan . | |
| 58-143853 | 8/1983 | Japan . | |
| 1079289 | 3/1984 | U.S.S.R. | 241/40 |

*Primary Examiner*—Hien H. Phan
*Assistant Examiner*—Clark F. Dexter
*Attorney, Agent, or Firm*—Finnegan, Henderson, Farabow, Garrett & Dunner

[57] ABSTRACT

A micromilling device includes a milling chamber, at least one nozzle for injecting a stream of solid particles to be milled into the chamber in a predetermined path, and impact elements positioned in the path for impacting the stream of solid particles.

6 Claims, 1 Drawing Sheet

MICROMILLING DEVICE

This application is a continuation of application Ser. No. 07/592,026, filed Oct. 2, 1990, abandoned.

BACKGROUND OF THE INVENTION

1. Field of the Invention

The present invention relates to an improvement of a swirl flow type jet mill in which solids are milled by using the energy of compressed air. More particularly, the invention relates to a micromilling device in which energy consumption during milling is reduced and the milled particle size distribution is narrowed.

2. Discussion of the Related Art

In a conventional swirl flow type jet mill which possesses a swirl milling chamber (which will be referred to below simply as a "jet mill"), compressed air is injected into the milling chamber from milling nozzles. The energy of the high-speed air stream causes collisions between solid particles, thereby milling a solid. The swirl flow produced by the high-speed air stream brings about centrifugal classification of the particles, resulting in particles with the required particle diameter.

Advantages of a jet mill include the fact that it is possible to mill solids that are sensitive to heat since injection of compressed air lowers the temperature due to an adiabatic expansion effect. Further, jet mills are suited to perform micromilling, since the milling is effected mainly through surface milling by collisions between particles.

On the other hand, a jet mill has several drawbacks. Since a large amount of compressed air is used, it is necessary to have a large compressor. Thereby the amount of energy consumed in milling by a jet mill is a very large quantity, some 2–5 times the amount consumed in a mechanical mill. Moreover, since collisions between particles are the main feature of the jet mill, ultrafine powder is liable to be produced, while other particles which have taken part in few collisions are discharged directly as coarse powder. This results in a broad milled particle size distribution.

An attempt to get a narrow milled particle size distribution has been proposed. This attempt involves the combined use of a classifier with a jet mill and the adoption of a closed-circuit milling system in which a material is milled in a jet mill to particles whose diameter is larger than the required diameter. These are classified by the coarse powder classifier, and coarse powder is returned to the mill again to produce the required particle diameter. This system makes it possible to mill material with a considerable narrow particle size distribution. However, this system is unable to provide any improvement with respect to the energy consumed in milling.

To reduce the energy consumption, the mill disclosed in Japanese Laid-open Utility Model Application Nos. 51-1000374, 51-1000375 and 56-64754 and Japanese Laid-open Patent Application No. 58-143853 are proposed. These mills employ systems in which there is a single milling nozzle for a single impact plate. These systems provide some improvement with respect to the energy consumed by milling. However, there is the drawback that if these mills are used alone the milled particle size distribution is greater than it is with a jet mill. These systems require a combination with a classifier. These systems have an added drawback that as single nozzles are employed, it is not possible to make the equipment large. Employing a single nozzle in large equipment would result in a drop in efficiency. The mill disclosed in Japanese Laid-open Patent Application No. 57-84756 has communication pipes, and so the structure becomes complex and the equipment is unpractical if there is a large number of milling nozzles.

SUMMARY OF THE INVENTION

The present invention has been made in view of the above circumstances. In a micromill in which impact elements are provided facing the lines of injection from milling nozzles, it is possible to use the two forces effectively that result from collisions between particles and impact of particles against the impact elements.

A further object of the present invention is that the milling energy efficiency will be high.

A further object of the invention is that milled material with a narrow milled particle size distribution is produced.

In order to achieve the above objects, and in accordance with the purposes of the invention as embodied and broadly described herein, a device for micromilling solid particles is provided, comprising a milling chamber, injection means for injecting a stream of the solid particle into the milling chamber in a first path defining an angle with a line bisecting the milling chamber, a support member disposed in the milling chamber, and impact element means connected to the support member and disposed in a second path opposing the first path for impacting the stream of solid particles.

BRIEF DESCRIPTION OF THE DRAWINGS

The accompanying drawings, which are incorporated in and constitute a part of the specification illustrate an embodiment of the invention and, together with the description, serve to explain the objects, advantages and principles of the invention. In the drawings.

DETAILED DESCRIPTION OF THE PREFERRED EMBODIMENTS

An embodiment of the invention will be described with reference to the drawings.

It is an aspect of the invention that, in a micromilling device constituted by a swirl flow type jet mill in which solid particles are milled by injection of compressed air via a plurality of milling nozzles, an impact element is provided forwardly with respect to the direction of injection from each milling nozzle in a manner such that it is struck by injected air.

Figure 1:
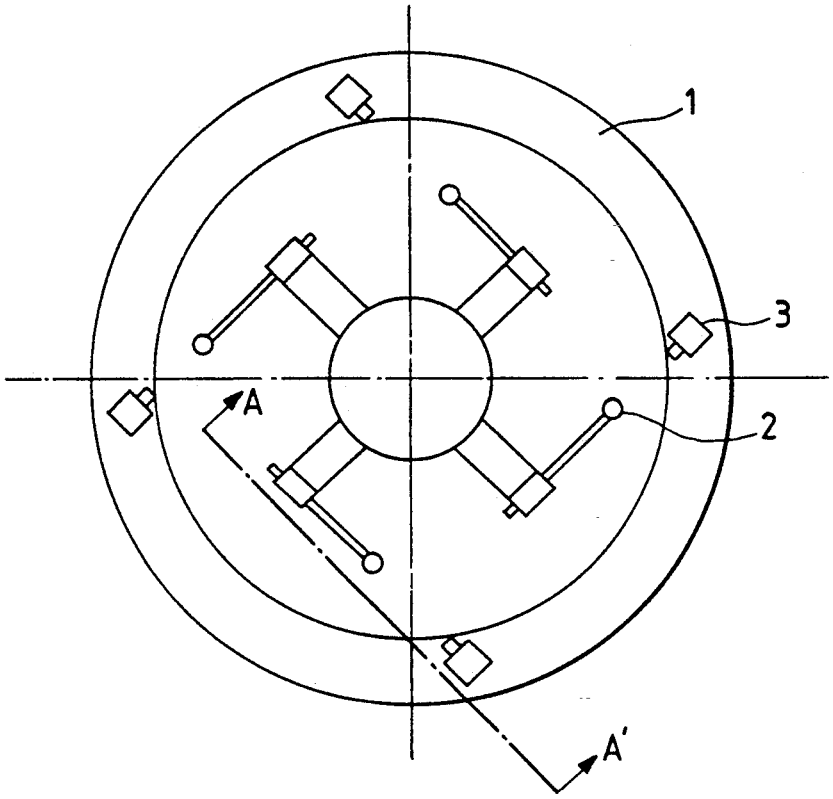
FIG. 1 is a top planar view of the micromill of the present invention.
Figure 2:
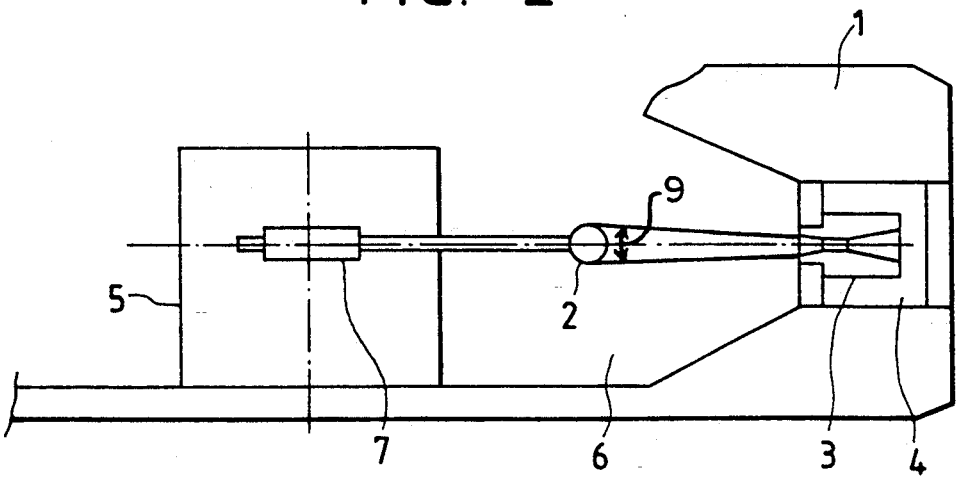
FIG. 2 is a cross-sectional view taken along the line A—A' of FIG. 1.

FIG. 1 is a top planar view of the micromill of the invention and FIG. 2 is a cross-sectional view taken along the line A—A' of FIG. 1. In the drawings, 1 indicates a micromill main body, 2 an impact element, 3 a milling nozzle, 4 a compressed air chamber, 5 a discharge pipe, 6 a swirl milling chamber, and 7 an impact element support member.

In the micromill of the invention, inside the swirl chamber 6 of the swirl type jet mill main body 1, an impact element 2 is installed in correspondence to each milling nozzle 3, facing the line of injection from this milling nozzle 3. This makes it possible to make effective use of the energy of compressed air that is normally consumed without being used.

The position in which each impact element is installed is such that, if the direction of the center of a stream of air injected from the corresponding milling nozzle is designated 0°, the center of the struck surface of the impact element is in conical range with a vertical angle that is within 20°, and the most effective condition is that the center of its struck surface is in line with the center of the injected air stream, i.e., the above noted vertical angle is 0°. If the angle is more than 20°, the impact element fails to have an effect, since the proportion of its struck surface that is away from the flow of injected compressed air becomes large.

Consider next the distance to the impact element. It is needed to make the distance between the front end of the struck surface of the impact element and the front end of the milling nozzle not more than 5 times the potential core zone (i.e., not more than 25 times the nozzle inner diameter). Preferably this distance is made 2–3 times the potential core zone. (The potential core zone means the zone in which injected compressed air possesses effective energy on injection from a nozzle. It is normally 5 times the nozzle inner diameter.) Making the distance greater than 5 times the potential core zone actually results in a decrease in the milling effect since it disturbs the air injected by other nozzles and thus disturbs the swirl flow which acts to classify particles.

Considering next the shape of the impact elements, possible shapes include spherical, cylindrical, oval, dome, and conical shapes. Particularly, a spherical shape is the more effective condition. For the same reasons as noted above for the installation distance, it is better if the size of each impact element is in a range such that no disturbance of the swirl flow or of compressed air injected from other nozzles is caused. The area of each impact element's surface or cross-section that is normal to the direction of the center of the injected air stream is needed to be not more than 50 times the cross-sectional area of the smallest inner diameter portion of the corresponding milling nozzle.

If the material of the impact elements are wear-resistant, the elements can be used without problems. Wear-resistant alloys, metals that have been given wear-resistance surface treatment and ceramics, and the like, are particularly suitable. Examples that can be cited of impact element materials include alloys in the form of cemented carbide alloys, cobalt-based stellite alloys, nickel-based Deloro alloys, iron-based Delchrome alloys, Tristyl alloys, Trivalloy intermetallic compounds, and ceramics in the form of oxides such as alumina, titania, zirconia, etc., carbides such as silicon carbide, chromium carbide, etc., nitrides such as silicon nitride, titanium nitride, etc. and borides such a chromium boride, titanium boride, etc.

There will now be given several specific examples of micromilling operations using the micromill of the present invention.

The micromill shown in FIG. 1 and FIG. 2 was used. The swirl milling chamber had an internal diameter of 420 mm, the height of its periphery was 50 mm, the height of its central portion was 100 mm, the inside diameter of its central bottom portion was 138 mm and it had a 74 mm high discharge pipe. The milling nozzles on the periphery of the swirl milling chamber consisted of 4 Laval nozzles with an inner diameter of 5.2 mm which were disposed offset at an angle of 35 degrees to the central directions. The raw material was supplied from the swirl milling chamber cover portion by the action of an air injection nozzle. A closed-circuit system was established by combining a micron separator (manufactured by HOSOKAWA MICRON KK) and milling was effected in the following conditions.

EXAMPLE 1

| | |
|---|---|
| Impact elements | |
| Number | 4 |
| Installation distance | 22 mm |
| Shape | Cylindrical |
| Size | 16 mm (diameter) × 35 mm |
| Material | SUS304 |
| Milling conditions | |
| Milling pressure | 7.6 kg/cm$_2$G |
| Supply pressure | 6.0 kg/cm$_2$G |
| Exhaust gas flow rate | 11–12 m$^3$/min |
| Secondary air flow rate | 1.2–1.5 m$^3$/min |

The raw material used was electronic photocopying toner that had been milled in a hammer mill (to a weight-average particle diameter $D_{50}$=300–500 μm). Milling was effected in the conditions noted above to bring the weight-average particle diameter $D_{50}$ (which will be referred to below simply as "$D_{50}$') to 11 μm. The particle size distribution was determined by means of a COULTER COUNTER TA-II (manufactured by the COULTER ELECTRONICS COMPANY). The results are indicated in Table 1.

COMPARISON EXAMPLE 1

Milling to give $D_{50}$=11 μm was effected in the same conditions as in Example 1 except that no impact elements were provided in the milling chamber. The results of this are indicated in Table 1.

EXAMPLE 2

Milling to give $D_{50}$=11 μm was effected in the same conditions as in Example 1 except that the centers of the struck surfaces of the impact elements were located precisely in line with the centers of injection by the corresponding milling nozzles.

EXAMPLE 3

Milling to give $D_{50}$=11 μm was effected in the same conditions as in Example 1 except that the centers of the struck surfaces of the impact elements were offset horizontally from the directions of the centers of injection from the corresponding milling nozzle injection by 15° going towards the outer periphery of the milling chamber.

EXAMPLE 4

Milling to give $D_{50}$=11 μm was effected in the same conditions as in Example 2 except that the installation distance of the impact elements (the distance between the front ends of the struck surfaces of the impact element and the front ends of the milling nozzles) was made 80 mm.

EXAMPLE 5

Milling to give $D_{50}$=11 μm was effected in the same conditions as in Example 2 except that the installation distance of the impact elements was made 140 mm.

EXAMPLE 6

Milling to give $D_{50}$=11 μm was effected in the same conditions as in Example 4 except that the shape of the impact elements was made spherical (diameter=16 mm).

EXAMPLE 7

Milling to give $D_{50}=11$ μm was effected in the same conditions as in Example 4 except that the impact elements were made the shape of square posts (16 mm×16 mm×30 mm) and the elements were installed so that flat surface portions thereof faced the milling nozzles.

EXAMPLE 8

Milling to give $D_{50}=11$ μm was effected in the same conditions as in Example 4 except that the shape of the impact elements was made spherical (diameter=20 mm).

EXAMPLE 9

Milling to give $D_{50}=11$ μm was effected in the same conditions as in Example 4 except that the shape of the impact elements was made spherical (diameter=37 mm).

The results of the above examples and comparison examples are indicated in Table 1.

TABLE 1

| | Impact element | | | Milling energy consumption | | Particle size distribution | | | |
|---|---|---|---|---|---|---|---|---|---|
| Shape | | Installation attitude (°) | Installation distance (mm) | Total (KWH/kg) | Milling (KWH/kg) | $D_{50}$ | Fine (<5m) pop % / vol % | Coarse (>20.2 m) | Rosin-Rammler ND |
| Example | Cylinder (16 mm$_\phi$ × 35 m) | 0 | 22 | 4.16 | 1.41 | 10.98 | 47.4 | 4.3 | 2.75 |
| Comparison Example 1 | — | — | — | 5.46 | 1.85 | 10.97 | 47.7 / 7.2 | 3.4 | 2.70 |
| Example 2 | Cylinder (16 m$_\phi$ × 35 m) | 0 | 22 | 3.65 | 1.24 | 10.95 | 46.2 / 7.0 | 3.4 | 2.82 |
| Example 3 | Cylinder (16 m $_\phi$ × 35 m) | 30 | 22 | 5.03 | 1.70 | 11.18 | 47.8 / 6.91 | 6.1 | 2.44 |
| Example 4 | Cylinder (16 m$_\phi$ × 35 m) | 0 | 80 | 2.94 | 1.00 | 10.06 | 47.8 | 2.7 | 2.90 |
| Example 5 | Cylinder (16 m$_\phi$ × 35 m) | 0 | 140 | 4.47 | 1.51 | 10.91 | 46.5 / 7.0 | 3.6 | 2.88 |
| Example 6 | Sphere (16 mm$_\phi$) | 0 | 80 | 2.68 | 0.90 | 11.01 | 46.0 / 6.8 | 3.4 | 2.94 |
| Example 7 | Square post (16 mm × 16 m × 30 m) | 0 | 80 | 4.64 | 1.56 | 11.05 / 7.3 | 47.2 | 7.8 | 2.45 |
| Example 8 | Sphere (20 mm$_\phi$) | 0 | 80 | 2.36 | 0.80 | 10.86 | 45.8 / 7.1 | 2.7 | 3.03 |
| Example 9 | Sphere (37 mm$_\phi$) | 0 | 80 | 3.55 | 1.63 | 10.90 | 46.0 / 7.0 | 4.0 | 2.65 |

As is clear from a comparison between the examples and the comparison example, installation of impact elements in the swirl milling chamber of a jet mill makes it possible to reduce the milling energy consumption while at the same time to provide a milled product with a sharp particle size distribution.

A comparison of Examples 1-3 shows that the milling power consumption can be reduced still further by optimization of the installation attitude of the each impact element (optimization of the amount of offset relative to the center of the struck surface of the impact element from the line of the center of injection by a milling nozzle injection). If one judges from the degree of dispersion from a milling nozzle (a Laval nozzle) and the results in Example 3, the energy of the compressed air can be used effectively if the installation attitude of the corresponding impact element is in the range ±10° from the center line of the injection nozzle (i.e., if the center of the struck surface of the impact element is within a conical range with a vertical angle 20° whose center is the direction of air injected from the milling nozzle). Installation attitude of 0° is the most effective condition.

A comparison of Examples 2, 4 and 5 shows that the milling power consumption can be reduced still further by optimization of the installation distance. The optimum installation distance varies depending on the powder that is used. Taking into consideration first the potential core zone in which the energy of compressed air injected from a milling nozzle is maximum and also entrainment zone of particles, the acceleration zone, zones of interference with streams of compressed air injected from other milling nozzles, and interference with the swirl dispersion zone, the installation distance range must be not more than 5 times the size of the potential core zone. The potential core zone is 26 mm (5×5.2 mm:nozzle inside diameter). The installation distance range is 0-130 mm.

A comparison of Examples 4, 6, and 7 shows that the milling power consumption can be reduced still further by optimization of the impact element shape. The impact element shape is preferably one that does not cause disordering of the streams of compressed air injected from milling nozzles. It was found that spherical, oval, cylindrical, dome, and conical shapes are particularly effective.

A comparison of Examples 8 and 9 shows that the milling power consumption can be reduced still further by optimization of the size of the impact elements. Given the spread of compressed air injected from a milling nozzle and the impact element installation range, it is found that it is preferable that the impact element size be in a range not exceeding 50 times the cross-sectional area of the smallest inner diameter portion of a milling nozzle. In the case of Examples 8 and 9, 50 times the cross-sectional area of the smallest milling nozzle inner diameter portion was 1061 mm$^2$ ($=\frac{1}{4}\times(5.2)^2\times3.14\times50$), the values of impact surface area were made 314 mm$^2$ in Example 8 and 1075 mm$^2$ in Example 9.

EXAMPLE 10

Raw material constituted by resin containing magnetic powder that had been milled in a hammer mill (to 300–500 μm) was milled in the same conditions as in Example 2 (using the micromiller that was employed in Examples 1–9) and using cemented carbide (Material WH40, manufactured by HITACHI KINZOKU KK), powder high-speed tool steel (HAP40, manufactured by HITACHI KINZOKU KK), SIALON (HCN10 manufactured by HITACHI KINZOKU KK) and SUS304 as the materials for the impact elements, respectively, facing 4 milling nozzles. Milling was effected for 4 hours with the raw material supplied at a rate of 20 kg/H, and the change in weight due to wear (the degree of wear) was determined. In order to eliminate differences due to the milling nozzles, the positions of the impact elements were changed once every hour. The results are indicated in Table 2.

TABLE 2

| Material | Milling time (hr) 1 | 2 | 3 | 4 | Total | Wear resistance ratio |
|---|---|---|---|---|---|---|
| Cemented carbide | $5.4 \times 10^{-3}$ | $7.3 \times 10^{-3}$ | $7.3 \times 10^{-3}$ | $5.8 \times 10^{-3}$ | $2.58 \times 10^{-2}$ | 96.6 |
| HAP40 | $1.0 \times 10^{-2}$ | $0.8 \times 10^{-2}$ | $0.8 \times 10^{-2}$ | $0.9 \times 10^{-2}$ | $3.5 \times 10^{-2}$ | 71.2 |
| Sialon | $1.0 \times 10^{-2}$ | $1.2 \times 10^{-2}$ | $1.3 \times 10^{-2}$ | $1.0 \times 10^{-2}$ | $4.5 \times 10^{-2}$ | 55.4 |
| SUS304 | $69.5 \times 10^{-2}$ | $61.3 \times 10^{-2}$ | $63.5 \times 10^{-2}$ | $54.9 \times 10^{-2}$ | 2.492 | 1 |

Note:
Degree of wear: $(W_{i-1} - W_i)/W_{i-1} \times 100$ (i = 1, 2, 3, 4) [Where W is the impact element weight (g) and i is the sampling time (hr)]

As is clear from the above results, the wear resistance of cemented carbide was 96.6 times better than that of SUS304, that of HAP40 71.2 times better, and that of SIALON 55.4 times better, i.e., all these materials offered good resistance to wear.

As is clear from the above results, thanks to the provision of impact elements facing the direction of injection from milling nozzles, the micromill of the invention makes it possible to reduce energy consumption and also to effect milling to a narrow milled particle size distribution. Also, by use of wear-resistant material, the invention makes it possible to mill powders that are strongly wear-resistant.

The foregoing description of the preferred embodiment of the invention has been presented for purposes of illustration and description. It is not intended to be exhaustive or to limit the invention to the precise form disclosed, and modifications and variations are possible in the light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A device for micromilling solid particles, comprising:

a milling chamber having a cylindrical sidewall;

injection means including at least first and second injection nozzles positioned in said sidewall at circumferentially spaced locations for injecting at least two streams of the solid particles in respective first and second paths, wherein the path from each nozzle is directed into said milling chamber at a corresponding acute angle relative to a line bisecting said milling chamber which pass through said each nozzle, and said paths are disposed in a same circumferential direction to create a combined, swilling circumferential flow of the two particle streams around an interior of said milling chamber;

a support member disposed in said milling chamber; and stationary impact element means connected to said support member and having a single generally spheroidal impact surface disposed in each of said first and second paths for impacting by the respective streams of said solid particles.

2. The device of claim 1, wherein said streams of solid particles are of a cone shape and said impact element means includes a separate spheroidal impact surface disposed in each said first and second paths and oriented substantially within a conical angle of between 0° and 20° of said streams of solid particles.

3. The milling device of claim 1, wherein said impact element means includes at least two spheroidal impact surfaces, said first and second injection nozzles have an internal diameter, and a distance from each said nozzle to each impact surface is not greater than 25 times said internal diameter.

4. The device of claim 1, wherein said impact element means has at least two spheroidal impact surfaces respectively disposed in said first and second paths, each said first and second injection nozzle having a neck of predetermined cross sectional area, and an area of each impact surface that impacts with the solid particles of said streams is not greater than 50 times said cross sectional area of the neck of said nozzle.

5. The device of claim 1, wherein said impact element means has an impact surface comprising a material selected from the group consisting of a metal alloy, a surface-treated metal, and a ceramic.

6. The device of claim 1, wherein said impact element means extends from said support member into said first and second paths.

* * * * *

UNITED STATES PATENT AND TRADEMARK OFFICE

CERTIFICATE OF CORRECTION

PATENT NO. : 5,277,369

DATED : January 11, 1994

INVENTOR(S) : Hiroyuki Moriya et al.

It is certified that error appears in the above-indentified patent and that said Letters Patent is hereby corrected as shown below:

Claim 1, column 8, line 12, change "disposed" to --directed--.

Signed and Sealed this

Sixteenth Day of August, 1994

*Attest:*

*Attesting Officer*

BRUCE LEHMAN

*Commissioner of Patents and Trademarks*